US009332788B2

(12) United States Patent
Jelveh

(10) Patent No.: US 9,332,788 B2
(45) Date of Patent: May 10, 2016

(54) ATTACHABLE GARMENT COLLAR COVER

(71) Applicant: Kouros Jelveh, Irvine, CA (US)

(72) Inventor: Kouros Jelveh, Irvine, CA (US)

( * ) Notice: Subject to any disclaimer, the term of this patent is extended or adjusted under 35 U.S.C. 154(b) by 146 days.

(21) Appl. No.: 14/045,746

(22) Filed: Oct. 3, 2013

(65) Prior Publication Data

US 2015/0096096 A1 Apr. 9, 2015

(51) Int. Cl.

| | |
|---|---|
| ***A43B 3/00*** | (2006.01) |
| ***A41B 3/04*** | (2006.01) |
| ***A41B 3/16*** | (2006.01) |
| ***A41B 3/14*** | (2006.01) |
| ***A41B 3/18*** | (2006.01) |
| ***A41B 3/02*** | (2006.01) |
| ***A43B 3/08*** | (2006.01) |

(52) U.S. Cl.

CPC ... *A41B 3/04* (2013.01); *A41B 3/02* (2013.01); *A41B 3/14* (2013.01); *A41B 3/16* (2013.01); *A41B 3/18* (2013.01); *A43B 3/00* (2013.01); *A43B 3/08* (2013.01)

(58) Field of Classification Search

CPC ..... A41D 27/14; A41D 27/16–27/18; A41B 3/04; A41B 3/14; A41B 3/02; A41B 3/18; A41B 3/00; A41B 3/08

USPC ..... 2/60, 129, 137, 139, 98

See application file for complete search history.

(56) References Cited

U.S. PATENT DOCUMENTS

| | | | | | |
|---|---|---|---|---|---|
| 790,064 | A | * | 5/1905 | Lawrenoe | 2/138 |
| 793,890 | A | * | 7/1905 | Maxon et al. | 2/60 |
| 797,971 | A | * | 8/1905 | Montgomery | 2/60 |
| 971,031 | A | * | 9/1910 | Ferguson | 2/139 |
| 982,646 | A | * | 1/1911 | Tim | 2/139 |
| 985,612 | A | * | 2/1911 | Maciarz | 2/129 |
| 1,007,396 | A | * | 10/1911 | Simpson | 2/60 |
| 1,022,734 | A | * | 4/1912 | Hamilton | 2/138 |
| 1,073,132 | A | * | 9/1913 | Hurd | 2/131 |
| 1,102,431 | A | * | 7/1914 | Parsons | 2/129 |
| 1,103,508 | A | * | 7/1914 | Hamilton et al. | 2/139 |
| 1,108,296 | A | * | 8/1914 | Wilmot | 2/129 |
| 1,153,455 | A | * | 9/1915 | Kaufman | 2/142 |
| 1,153,693 | A | * | 9/1915 | Kaufman | 2/139 |
| 1,160,378 | A | * | 11/1915 | Cates | 2/98 |
| 1,231,206 | A | * | 6/1917 | Schenck | 2/60 |
| 1,258,581 | A | * | 3/1918 | Lussy | 2/60 |
| 1,260,544 | A | * | 3/1918 | Hurd | 2/129 |
| 1,325,552 | A | * | 12/1919 | Kunz | 254/50.1 |
| 1,403,769 | A | * | 1/1922 | Gross | 2/132 |
| 1,409,244 | A | * | 3/1922 | Scovronek | 2/139 |
| 1,526,324 | A | * | 2/1925 | Dormandy | 2/131 |

(Continued)

*Primary Examiner* — Shaun R Hurley
*Assistant Examiner* — Bao-Thieu L Nguyen
(74) *Attorney, Agent, or Firm* — Invent Capture, LLC.; Samuel S. Cho

(57) ABSTRACT

Various embodiments of a novel attachable garment collar cover are disclosed. In one embodiment, the attachable garment collar cover has a first collar cover blade, a second collar cover blade, a first button hole edge, a second button hole edge, a rear elastic, and a collar insert opening that can form an arched groove. A collar portion of a shirt, a dress, a coat, a blouse, or another article of clothing can be inserted into the collar insert opening of the attachable garment collar cover, and be fastened by the rear elastic of the attachable garment collar cover. The attachable garment collar cover completely encapsulates the collar portion of the article of clothing to protect and/or hide the collar from stains and wear-and-tear. When attached to the collar portion of the article of clothing, the attachable garment collar cover can also provide a pleasant and unique fashion statement.

18 Claims, 9 Drawing Sheets

400

(56) References Cited

U.S. PATENT DOCUMENTS

| | | | | | |
|---|---|---|---|---|---|
| 1,563,274 | A | * | 11/1925 | Furman | 2/129 |
| 1,613,653 | A | * | 1/1927 | Goetting | 2/129 |
| 1,631,985 | A | * | 6/1927 | Roberts | 2/131 |
| 1,677,504 | A | * | 7/1928 | Sweetser | 2/129 |
| 1,733,297 | A | * | 10/1929 | Deutschmann | 2/131 |
| 1,742,816 | A | * | 1/1930 | Kennedy et al. | 2/129 |
| 1,757,861 | A | * | 5/1930 | Halperin | 2/141.1 |
| 1,768,384 | A | * | 6/1930 | Villasenor | 2/60 |
| 1,980,394 | A | * | 11/1934 | Falcon | 2/98 |
| 2,116,685 | A | * | 5/1938 | Nicolet | 2/50 |
| 2,164,751 | A | * | 7/1939 | Newman | 2/139 |
| 2,180,758 | A | * | 11/1939 | Honigsberg et al. | 2/116 |
| 2,182,486 | A | * | 12/1939 | Broder | 2/139 |
| 2,233,477 | A | * | 3/1941 | Hilberg | 442/214 |
| 2,500,985 | A | * | 3/1950 | Goetz | 2/127 |
| 2,569,693 | A | * | 10/1951 | Sacchitella | 2/139 |
| 2,601,037 | A | * | 6/1952 | Liebowitz | 223/2 |
| 2,633,576 | A | * | 4/1953 | Powers et al. | 2/60 |
| 2,637,034 | A | * | 5/1953 | Smith | 2/60 |
| 2,800,660 | A | * | 7/1957 | Myrick | 2/116 |
| 2,885,682 | A | * | 5/1959 | Koenig | 2/124 |
| 2,920,328 | A | * | 1/1960 | Hammersley | 2/98 |
| 2,997,718 | A | * | 8/1961 | Jacobs | 2/139 |
| 4,937,884 | A | * | 7/1990 | Sherman | 2/129 |
| D367,951 | S | * | 3/1996 | Cupples et al. | D2/602 |
| 5,956,769 | A | * | 9/1999 | Stepney | 2/129 |
| 7,716,750 | B2 | * | 5/2010 | Sato | 2/152.1 |
| 7,849,520 | B2 | * | 12/2010 | Blenkarn | 2/129 |

* cited by examiner

200

300

400

500

600

700

800

ATTACHABLE GARMENT COLLAR COVER

FIELD OF THE INVENTION

The present invention generally relates to garments and garment accessories. More specifically, various embodiments of the invention relate to an attachable garment collar cover. In particular, at least some embodiments of the present invention relate to a novel attachable garment collar cover which encapsulates a collar portion of a shirt, a dress, a coat, a blouse, or another article of clothing.

BACKGROUND OF THE INVENTION

Various articles of clothing, such as shirts, dresses, coats, and blouses, each have a collar that surrounds a wearer's neck. In general, a collar is part of a fashion or design statement for a particular garment, and sometimes also serves a functional role of protecting the wearer's neck against wind and cold weather. In some designs, a collar can be made by modifying and utilizing a fabric material used in a main body of the same garment. In other designs, a collar can also be made of fabric materials different from other parts of the same garment.

In most cases, a collar is permanently attached to the main body of a garment by stitching. Unfortunately, for most cloth wearers, the collar tends to get dirty earlier than other parts of the garment due to neck perspiration and body oil soaking into the collar. A heavy stain commonly referred to as "ring around the collar" is a typical problem for many garments that incorporate collars. Because a collar is permanently attached to the main body of a garment, it is difficult to just wash or clean the collar selectively. In many cases, the garment is unnecessarily more frequently washed in order to clean the collar.

Furthermore, a cloth wearer's neck tends to brush against the collar frequently, thereby causing a premature wear-and-tear of the collar, compared to the main body of the garment. The premature wear-and-tear of the collar shortens the usability and the operating life of the garment. Moreover, if the fabric used in the collar is different from the fabric used in the main body of the garment, undesirable discoloration, wrinkles, or damages may be more pronounced if the garment is exposed to ironing, dryer heat, or certain chemicals in a detergent.

Therefore, it may be advantageous to provide a novel attachable garment collar cover that protects the collar from stains and damages of daily wear and tear to extend the operating life of the garment. Furthermore, it may be also advantageous to provide a novel attachable garment collar cover that can hide existing damages to the collar, which improves the operating life of the garment.

In addition, it may be also advantageous to provide a novel attachable garment collar cover that can be detached from the garment for separate washing and cleaning, which can reduce the need for frequent washing of the garment. Moreover, it may be also advantageous to provide a novel attachable garment collar cover that bears a different design, texture, pattern, styling, collar shape, collar sizing, and/or color profile from the garment, which creates the effect of a unique fashion statement in combination with the garment.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a novel attachable garment collar cover is disclosed. This attachable garment collar cover comprises: a first collar cover blade made of a multilayer fabric; a second collar cover blade made of the multilayer fabric; a collar insert opening configured to encapsulate a collar portion of an article of clothing, wherein the first collar cover blade and the second collar cover blade encapsulate a first side and a second side of the collar portion, when the collar portion is inserted into the collar insert opening; a rear attachment element comprising at least one of an elastic, a zipper, a clasp, a clip, and a pin, wherein the rear attachment element is located on a rear portion of the attachable garment collar cover, and wherein the rear attachment element enables secure fastening of the collar portion of the article of clothing, when the collar portion is inserted into the collar insert opening; a first cover button hole configured to fasten with a collar button on the collar portion of the article of clothing, when the collar portion is inserted into the collar insert opening; and a second cover button hole configured to overlap an underlying button hole of the article of clothing.

Furthermore, in another embodiment of the invention, another novel attachable garment collar cover is disclosed. This attachable garment collar cover comprises: a first collar cover blade made of a multilayer fabric; a second collar cover blade made of the multilayer fabric; a collar insert opening configured to encapsulate a collar portion of an article of clothing, wherein the first collar cover blade and the second collar cover blade encapsulate a first side and a second side of the collar portion, when the collar portion is inserted into the collar insert opening; a rear elastic located on a rear portion of the attachable garment collar cover, and wherein the rear elastic enables secure fastening of the collar portion of the article of clothing, when the collar portion is inserted into the collar insert opening; a first cover button hole configured to fasten with a collar button on the collar portion of the article of clothing, when the collar portion is inserted into the collar insert opening; and a second cover button hole configured to overlap an underlying button hole of the article of clothing.

DETAILED DESCRIPTION

Figure 1:
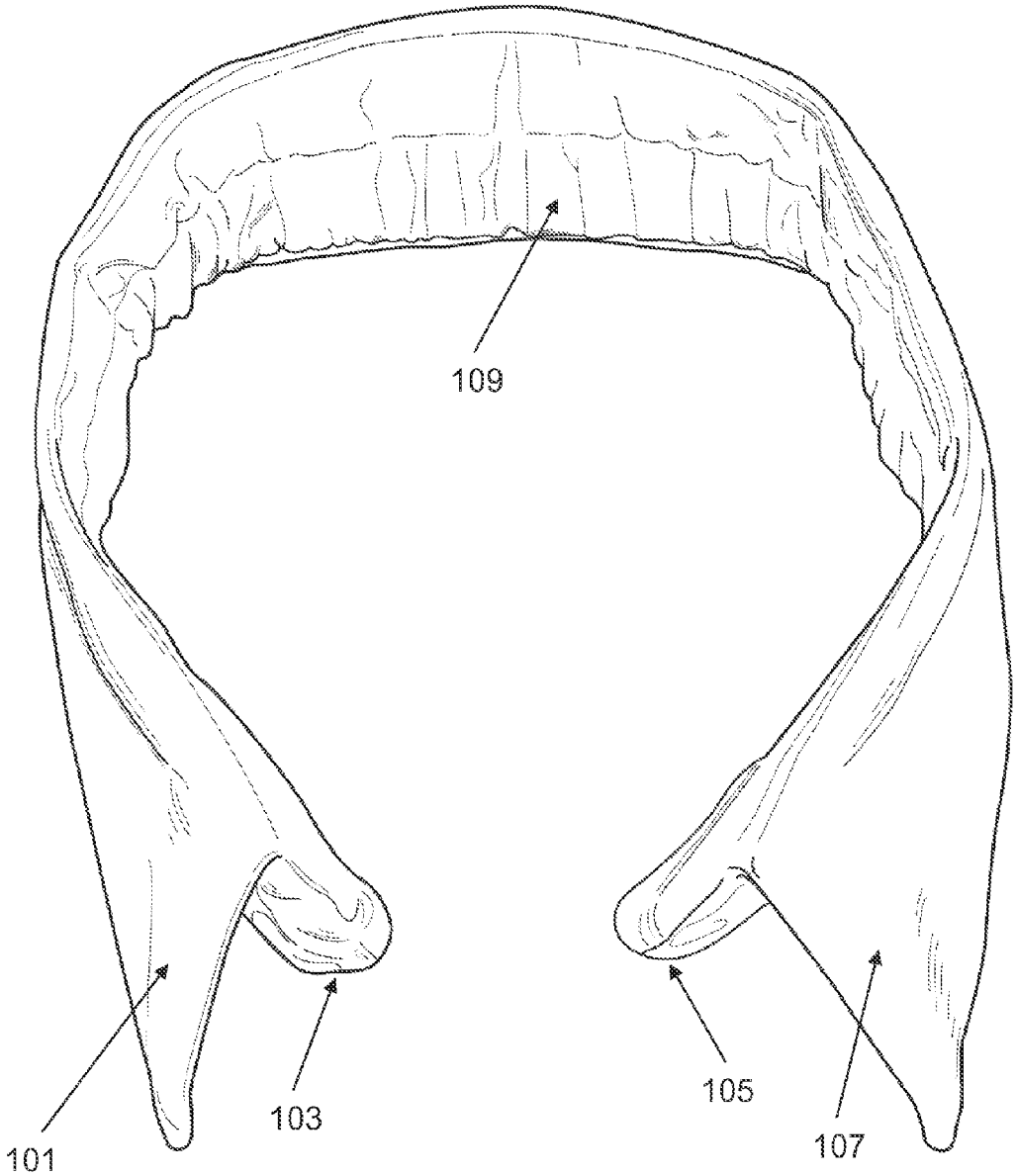
FIG. 1 shows a frontal perspective view of an attachable garment collar cover in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of procedures, logic blocks, processing, and/or other symbolic representations that directly or indirectly resemble an attachable garment collar cover. These process descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention do not inherently indicate any particular order nor imply any limitations in the invention.

In general, embodiments of the invention relate to a novel attachable garment collar cover, which encapsulates and protects the collar from stains and damages of daily wear and tear to extend the operating life of the garment. Embodiments of the invention also relate to a novel attachable garment collar cover, which encapsulates and hides existing damages to the collar, which can extend the operating life of the garment.

In addition, embodiments of the invention also relate to a novel attachable garment collar cover that can be detached from the garment for separate washing and cleaning, which in turn reduces the need for frequent washing of the garment. Furthermore, embodiments of the invention also relate to a novel attachable garment collar cover that bears a different design, texture, collar shape, collar sizing, pattern, styling, and/or color profile from the garment, which in turn engenders a unique fashion statement in combination with the garment.

For the purpose of describing the invention, a term "garment" is defined as an article of clothing, such as a shirt, a dress, a coat, and a blouse.

Moreover, a term "collar" or "collar portion" is defined as a section of an article of clothing that surrounds, covers, or frames a wearer's neck area. In one example, a collar may be formed by folding, cutting, and/or padding a fabric material that also constitutes a main body of a garment. In another example, a collar may be formed by stitching a separate piece of fabric to a main body of a garment.

In addition, for the purpose of describing the invention, a term "attachable" is defined as having an ability to be attached to or detached from another element. For example, an attachable garment collar cover is capable of being attached to or detached from a garment, especially around a collar portion of the garment. Furthermore, in a preferred embodiment of the invention, encapsulating the collar portion of the garment with the attachable garment collar cover is an example of attaching the attachable garment collar cover to the garment.

FIG. 1 shows a frontal perspective view of an attachable garment collar cover (100) in accordance with an embodiment of the invention. In a preferred embodiment of the invention, the attachable garment collar cover (100) comprises a first collar cover blade (101), a first button hole edge (103), a second collar cover blade (107), a second button hole edge (105), and a rear elastic (109) embedded inside the garment collar cover (100). In an alternative embodiment of the invention, the attachable garment collar cover (100) can utilize a non-elastic material embedded inside the garment collar cover (100), instead of the rear elastic (109), to tighten and secure the attachable garment collar cover (100) to a collar portion of an article of clothing. For example, two bend semi-rigid liners can be incorporated in the garment collar cover (100) to provide securing and tightening of the attachable garment collar cover (100) to the collar portion of the article of clothing. In the preferred embodiment of the invention, the attachable garment collar cover is made of a multilayer fabric. For example, a multiple number of fabric layers can be stitched together to form the first collar cover blade (101) and the second collar cover blade (107). Similarly, a same set or a different set of a multiple number of fabric layers can be stitched together to embed the rear elastic (109), while forming the first button hole edge (103) and the second button hole edge (105).

Continuing with FIG. 1, in the preferred embodiment of the invention, the attachable garment collar cover (100) has a groove (e.g. 211 of FIG. 2) in a lower portion of the attachable garment collar cover (100), wherein the groove on the attachable garment collar cover (100) can encapsulate a collar portion of a shirt, a dress, a coat, a blouse, or another article of clothing. The rear elastic (109) embedded between multiple fabric layers of the attachable garment collar cover (100) can provide a tight and secure fit between the attachable garment collar cover (100) and the collar portion of the shirt, the dress, the coat, the blouse, or another article of clothing, when the collar portion is inserted into the groove on the attachable garment collar cover (100).

In another embodiment of the invention, instead of using the rear elastic (109), the attachable garment collar cover (100) may utilize buttons, button holes, zippers, clasps, and/or pins located in a rear portion of the attachable garment collar cover (100) to enable a tight and secure fit between the attachable garment collar cover (100) and the collar portion of the shirt, the dress, the coat, the blouse, or another article of clothing, when the collar portion is inserted into the groove on the attachable garment collar cover (100). Furthermore, in one embodiment of the invention, it may be desirable to incorporate magnetic strips and magnetic buttons in the attachable garment collar cover (100) to secure and tighten the attachable garment collar cover (100) with the collar portion of the article of clothing.

Furthermore, in one embodiment of the invention, the attachable garment collar cover (100) may have an identical or similar color, pattern, styling, collar shape, collar sizing, and texture to the shirt, the dress, the coat, the blouse, or another article of clothing with the collar portion that gets inserted into the attachable garment collar cover (100), so that undesirable visual or design contrasts between the attachable garment collar cover (100) and the collar portion of the shirt, the dress, the coat, the blouse, or another article of clothing can be minimized.

In another embodiment of the invention, the attachable garment collar cover (100) may intentionally exhibit a unique, contrasting, and/or different color, pattern, styling, collar shape, collar sizing, and texture to the shirt, the dress, the coat, the blouse, or another article of clothing with the collar portion that gets inserted into the attachable garment collar cover (100), so that a unique fashion statement can be achieved when the attachable garment collar cover (100) encapsulates the collar portion of the shirt, the dress, the coat, the blouse, or another article of clothing.

Moreover, in a preferred embodiment of the invention, the first button hole edge (103) and the second button hole edge (105) each contain a cover button hole (e.g. 401, 405 in FIG. 4), which can overlap an underlying button hole (e.g. 407 in FIG. 4) or be fastened with a corresponding button (e.g. 411 in FIG. 4) on a collar portion of an article of clothing. In another embodiment of the invention, zippers, clasps, clips, pins, and/or another attachment element may be utilized in combination with or instead of the cover button hole. Furthermore, in one embodiment of the invention, a strap attached to an inner liner of the attachable garment collar cover may be provided to further secure the attachable garment collar cover to the collar portion of the article of clothing. This strap may utilize buttons, clips, pins, clasps, zippers, or another attachment-enabling element to fasten the attachable garment collar cover to the collar portion of the article of clothing.

Figure 2:
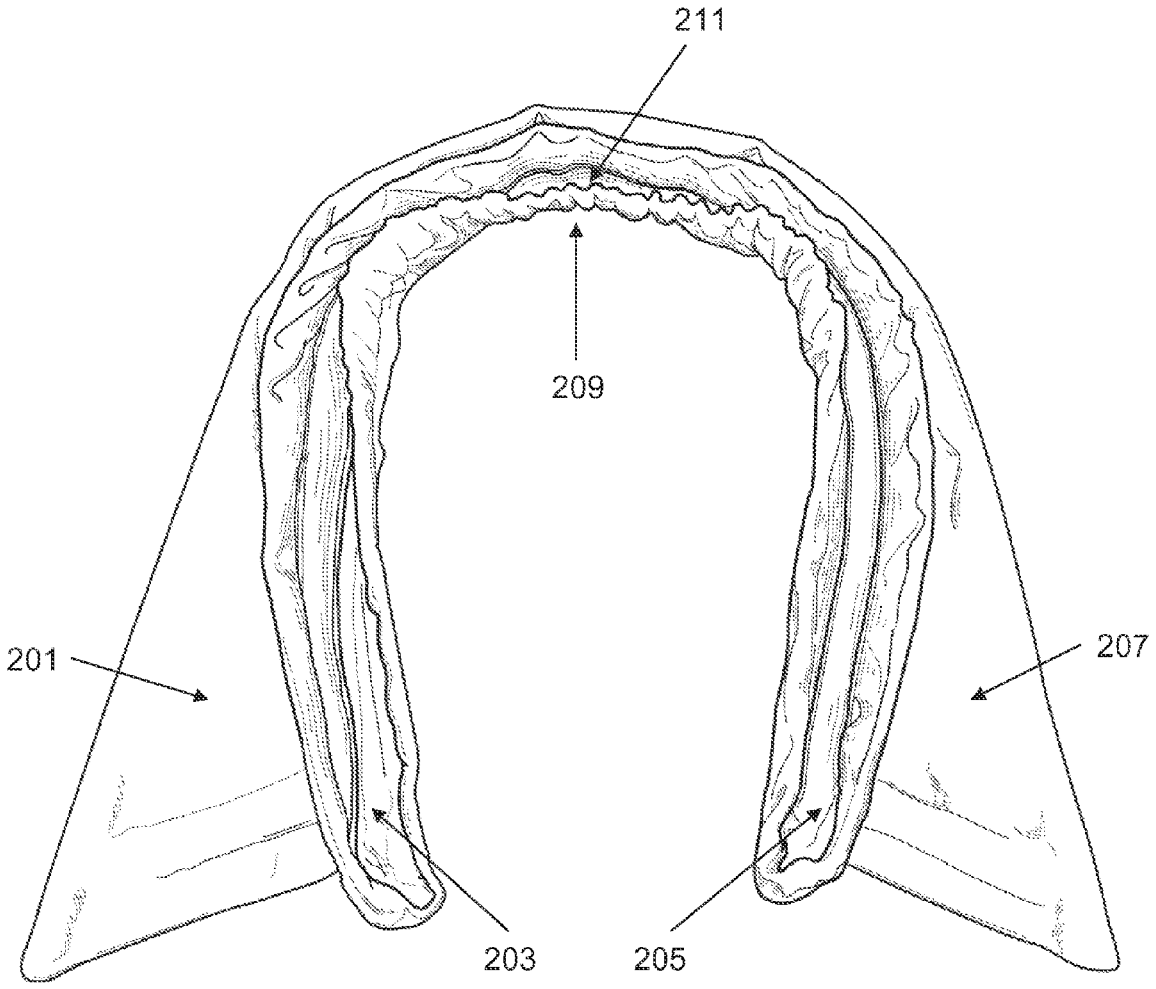
FIG. 2 shows a bottom perspective view of an attachable garment collar cover in accordance with an embodiment of the invention.

FIG. 2 shows a bottom perspective view of an attachable garment collar cover (200) in accordance with an embodiment of the invention. As shown in FIG. 2, in a preferred embodiment of the invention, the bottom portion of the attachable garment collar cover (200) comprises a first collar cover blade (207), a first groove edge (205), a second collar cover blade (201), a second groove edge (203), an arched groove (211), and a rear elastic (209) embedded inside the garment collar cover (200). In the preferred embodiment of the invention, the arched groove (211) spans from the first groove edge (205) to the second groove edge (203), and is configured to encapsulate a collar portion of an article of clothing.

In one example, the encapsulation of the collar portion of the article of clothing by the attachable garment collar cover (200) can be achieved when the collar portion of the article of clothing is inserted into the arched groove (211). Once inserted into the arched groove (211) of the attachable garment collar cover (200), the collar portion can be fastened by the tightening elastic action of the rear elastic (209) embedded in the attachable garment collar cover (200)

In another example, the encapsulation of the collar portion of the article of clothing by the attachable garment collar cover (200) can be achieved by attaching a portion of the attachable garment collar cover (200) to the collar portion of the article of clothing using clips, pins, clasps, zippers, or another attachment-enabling element.

Continuing with FIG. 2, in the preferred embodiment of the invention, the arched groove (211) is flexible and can be easily bent or shaped into other geometrical shapes, such as a straight-line groove or a semicircle groove with a different diameter. In another embodiment of the invention, the arched groove (211) is substantially rigid and is designed to only encapsulate collars that have matching geometrical shapes.

In the preferred embodiment of the invention, the attachable garment collar cover (200) is made of a multilayer fabric. For example, a multiple number of fabric layers can be stitched together to form the first collar blade (207) and the second collar cover blade (201). Similarly, a same set or a different set of a multiple number of fabric layers can be stitched together to embed the rear elastic (209), while also forming the arched groove (211), the first groove edge (205), and the second groove edge (203). In the preferred embodiment of the invention, the arched groove (211) is continuous from the first groove edge (205) to the second groove edge (203) to enable easy insertion of a collar portion of an article of clothing into the attachable garment collar cover (200).

Instead of using the rear elastic (209) as shown in FIG. 2, the attachable garment collar cover (200) may utilize buttons, button holes, clasps, zippers, and/or pins located in a rear portion of the attachable garment collar cover (200) to enable a tight and secure fit between the attachable garment collar cover (200) and a collar portion of an article of clothing, when the collar portion is inserted into the arched groove (211) on the attachable garment collar cover (200).

Furthermore, in one embodiment of the invention, the attachable garment collar cover (200) may have an identical or similar color, pattern, styling, collar shape, collar sizing, and texture to an article of clothing with a collar portion that gets inserted into the attachable garment collar cover (200), so that undesirable visual or design contrasts between the attachable garment collar cover (200) and the collar portion of the article of clothing can be minimized.

In another embodiment of the invention, the attachable garment collar cover (200) may intentionally exhibit a unique, contrasting, and/or different color, pattern, styling, collar shape, collar sizing, and texture to an article of clothing with a collar portion that gets inserted into the attachable garment collar cover (200), so that a unique fashion statement can be achieved when the attachable garment collar cover (200) encapsulates the collar portion of the article of clothing.

Figure 3:
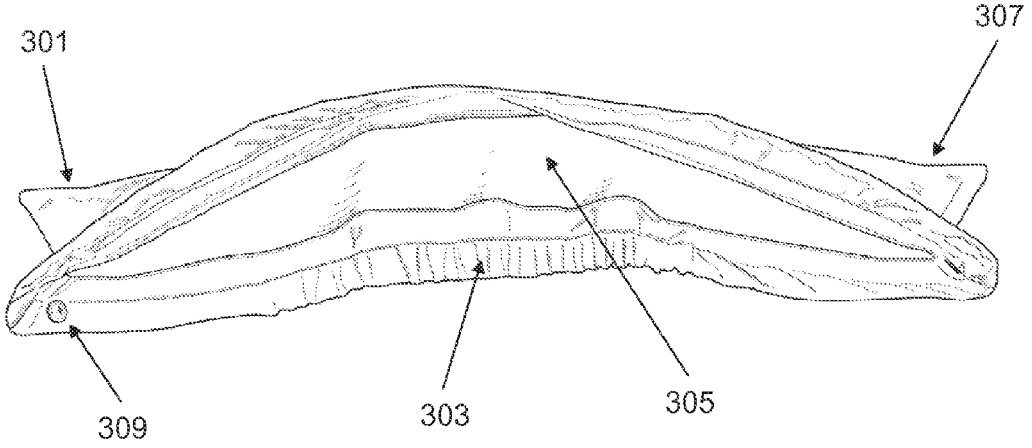
FIG. 3 shows a collar insert opening view of an attachable garment collar cover in accordance with an embodiment of the invention.

FIG. 3 shows a collar insert opening view of an attachable garment collar cover (300) in accordance with an embodiment of the invention. In a preferred embodiment of the invention, the attachable garment collar cover (300) includes a collar insert opening (305) along a long edge that embeds a rear elastic (303) in the attachable garment collar cover (300). As shown by FIG. 3, the attachable garment collar cover (300) also includes a first collar cover blade (307) and a second collar cover blade (301). In addition, a collar cover button (309) is located on the opposite inner side of the second cover button hole (e.g. 401 of FIG. 4), so that the second cover button hole (e.g. 401 of FIG. 4) and the underlying shirt collar button hole (e.g. 407 of FIG. 4) can be fastened together by the collar cover button (309).

In the preferred embodiment of the invention, the collar insert opening (305) can be shaped into an arched groove (e.g. 211 of FIG. 2) by straightening and then bending a pair of long edges. Even though only the rear elastic (303) is shown as being embedded in one of the long edges in FIG. 3, in another embodiment of the invention, one or more extra elastic materials can also be embedded around the pair of long edges. Yet in another embodiment of the invention, clasps, zippers, clips, pins, and/or another attachment element may be placed around the pair of long edges instead of any embedded elastic materials for securing and tightening the attachable garment collar cover (300) when a collar portion of an article of clothing is inserted into the collar insert opening (305). Furthermore, in one embodiment of the invention, a strap attached to an inner liner of the attachable garment collar cover may be provided to further secure the attachable garment collar cover to the collar portion of the article of clothing.

Figure 4:
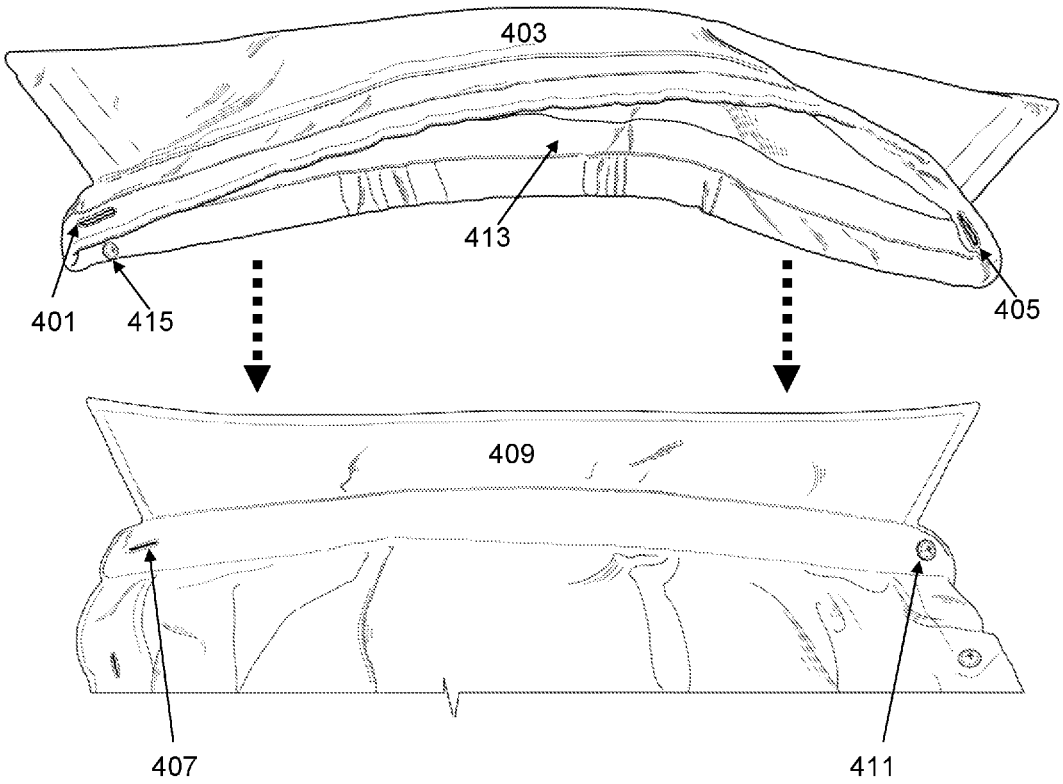
FIG. 4 shows a collar insert opening view of an attachable garment collar cover and a collar portion of a garment to be inserted into the attachable garment collar cover, in accordance with an embodiment of the invention.

FIG. 4 shows a collar insert opening view (400) of an attachable garment collar cover (403) and a shirt collar (409) to be inserted into the attachable garment collar cover (403), in accordance with an embodiment of the invention. In a preferred embodiment of the invention, the attachable garment collar cover (403) has a collar insert opening (413) that encapsulates the shirt collar (409), when the shirt collar (409) is inserted into the collar insert opening (413). Preferably, the collar insert opening can be shaped like an arched groove (e.g. 211 of FIG. 2) in a lower portion of the attachable garment collar cover (403) after tugging in a substantial portion or an entire portion of the shirt collar (409). In addition, in one embodiment of the invention, the collar insert opening (413) may be lined with a curvature-forming or curvature-maintaining liner that contributes to maintenance of a desired curvature of the attachable garment collar cover (403). This curvature-forming or curvature-maintaining liner may be made of flexible synthetic material.

Furthermore, in the preferred embodiment of the invention, a first cover button hole (405) can be fastened in position with a corresponding shirt collar button (411) after the shirt collar (409) is inserted into the collar insert opening (413). For example, the first cover button hole (405) on the attachable garment cover can fasten with a topmost collar button (e.g. 411) among a regular vertical column of buttons that are not specially made for the attachable garment collar cover. Similarly, a second cover button hole (401) can overlap an underlying shirt collar button hole (407) after the shirt collar is inserted into the collar insert opening. Then, the second cover button hole (401) and the underlying shirt collar button hole (407) can be fastened together by a collar cover button (415) located on the opposite inner side of the second cover button hole (401). In another embodiment of the invention, the second cover button hole (401) and the underlying shirt collar button hole (407) can be fastened together by magnetic elements. Furthermore, the second cover button hole (401) and the underlying shirt collar button hole (407) can also be fastened together by the shirt collar button (411), if the shirt wearer desires to tighten the top button on the shirt. Furthermore, the shirt wearer can also place a tie or another desirable clothing element around the attachable garment collar cover. In another embodiment of the invention, clasps, zippers, clips, pins, and/or another attachment element may be utilized in combination with or instead of the cover button holes (401, 405), the underlying shirt collar button hole (407), and the shirt collar button (411).

Moreover, in one embodiment of the invention, the attachable garment collar cover (403) may have an identical or similar color, styling, pattern, collar shape, collar sizing, and texture to the shirt with the shirt collar (409) that gets inserted into the attachable garment collar cover (403), so that undesirable visual or design contrasts between the attachable garment collar cover (403) and the shirt collar (409) can be minimized.

In another embodiment of the invention, the attachable garment collar cover (403) may intentionally exhibit a unique, contrasting, and/or different color, styling, pattern, collar shape, collar sizing, and texture to the shirt, with the shirt collar (409) that gets inserted into the attachable garment collar cover (403), so that a unique fashion statement can be achieved when the attachable garment collar cover (403) encapsulates the shirt collar (409).

The shirt collar (409) as illustrated in FIG. 4 is merely an example of a collar portion of an article of clothing that can utilize an embodiment of the present invention related to the attachable garment collar cover. In other embodiments of the invention, other articles of clothing with collar portions, such as dresses, coats, and blouses, can also utilize various embodiments of the attachable garment collar cover. Moreover, various embodiments of the present invention can be utilized with various collar blades and shapes, including collar shapes that are not illustrated in the figures.

Figure 5:
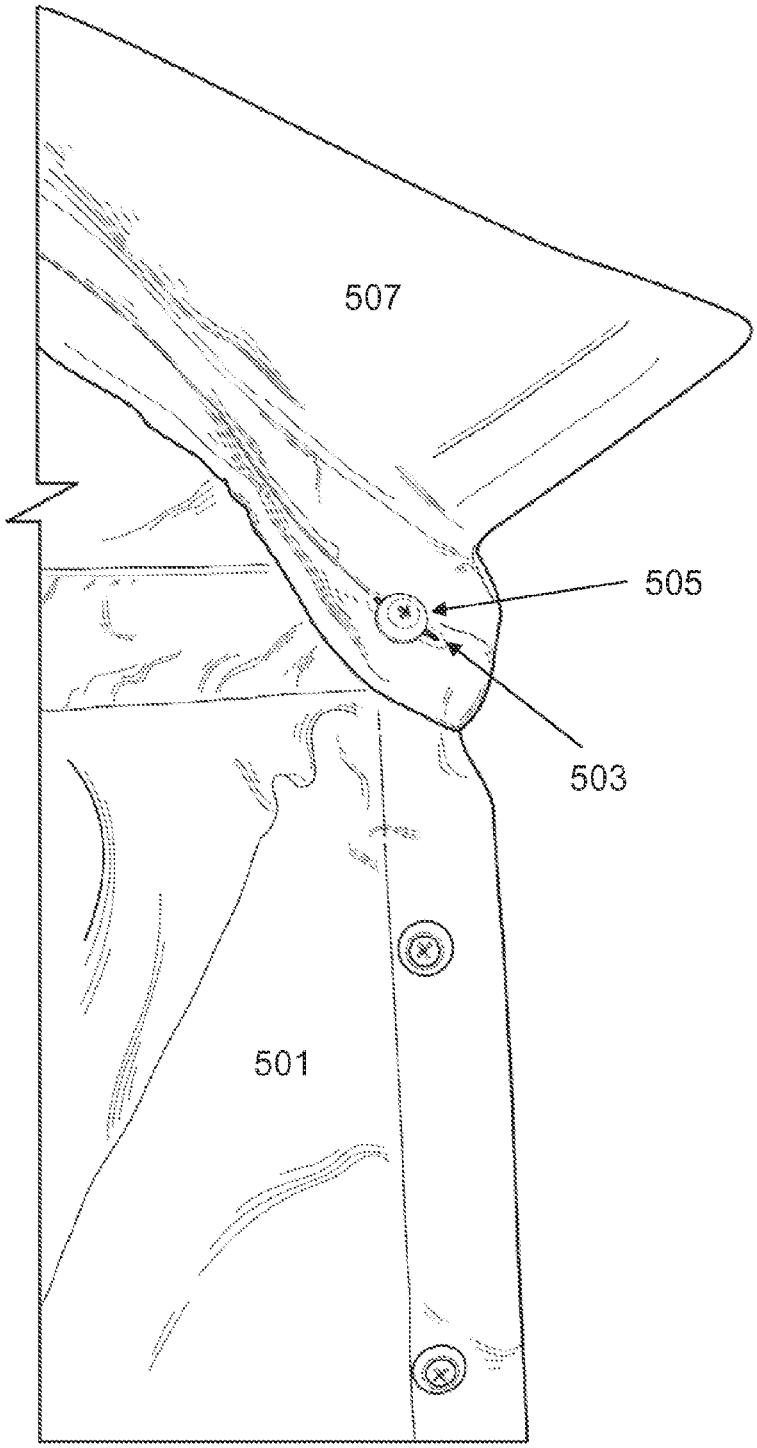
FIG. 5 shows a partial side view of an attachable garment collar cover encapsulating a collar portion of a garment, in accordance with an embodiment of the invention.

FIG. 5 shows a partial side view (500) of an attachable garment collar cover (507) encapsulating a collar portion of a shirt (501), in accordance with an embodiment of the invention. In a preferred embodiment of the invention, a collar portion of a garment, such as the collar portion of the shirt (501) as illustrated in FIG. 5, is inserted into a collar insert opening (e.g. 413 of FIG. 4) of the attachable garment collar cover (507).

Furthermore, in the preferred embodiment of the invention, a first cover button hole (503) of the attachable garment collar cover (507) is fastened and tightened with a shirt collar button (505) on the shirt (501), when the collar portion of the shirt (501) is inserted into the collar insert opening of the attachable garment collar cover (507), as shown in FIG. 5. In another embodiment of the invention, clasps, zippers, clips, pins, and/or another attachment element may be utilized in combination with or instead of the cover button hole. Moreover, in another embodiment of the invention, the attachable garment collar cover (507) may encapsulate a collar portion of another article of clothing, such as a dress, a coat, and a blouse, instead of the shirt (501).

Figure 6:
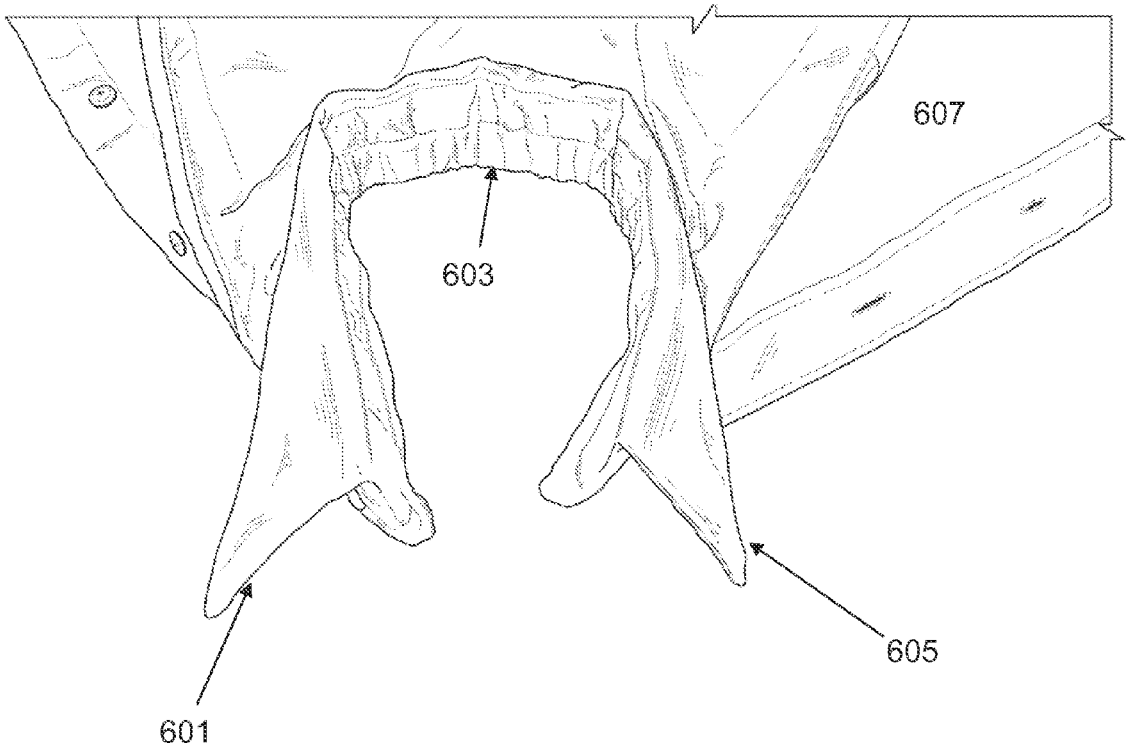
FIG. 6 shows a partial frontal view of an attachable garment collar cover encapsulating a collar portion of a garment, in accordance with an embodiment of the invention.

FIG. 6 shows another partial frontal view (600) of an attachable garment collar cover encapsulating a collar portion of a shirt (607), in accordance with an embodiment of the invention. In this embodiment of the invention, the attachable garment collar cover is shown with a first collar cover blade (601), a second collar cover blade (605), and a rear elastic (603). As shown in FIG. 6, in the preferred embodiment of the invention, when the attachable garment collar cover encapsulates a collar portion of the shirt (607), the attachable garment collar cover may have an identical or similar color, styling, pattern, collar shape, collar sizing, and texture to the shirt (607), so that undesirable visual or design contrasts between the attachable garment collar cover and the collar portion of the shirt (607) can be minimized. In another embodiment of the invention, the attachable garment collar cover may intentionally exhibit a unique, contrasting, and/or different color, styling, pattern, collar shape, collar sizing, and texture to the shirt (607), so that a unique fashion statement can be achieved when the attachable garment collar cover encapsulates the collar portion of the shirt (607).

Furthermore, in the preferred embodiment of the invention, the attachable garment collar cover has a groove (e.g. 211 of FIG. 2) in a lower portion of the attachable garment collar cover, wherein the groove on the attachable garment collar cover can encapsulate the collar portion of the shirt (607). The rear elastic (603) embedded between multiple fabric layers of the attachable garment collar cover can provide a tight and secure fit between the attachable garment collar cover and the collar portion of the shirt (607), when the collar portion is inserted into the groove on the attachable garment collar cover.

Figure 7:
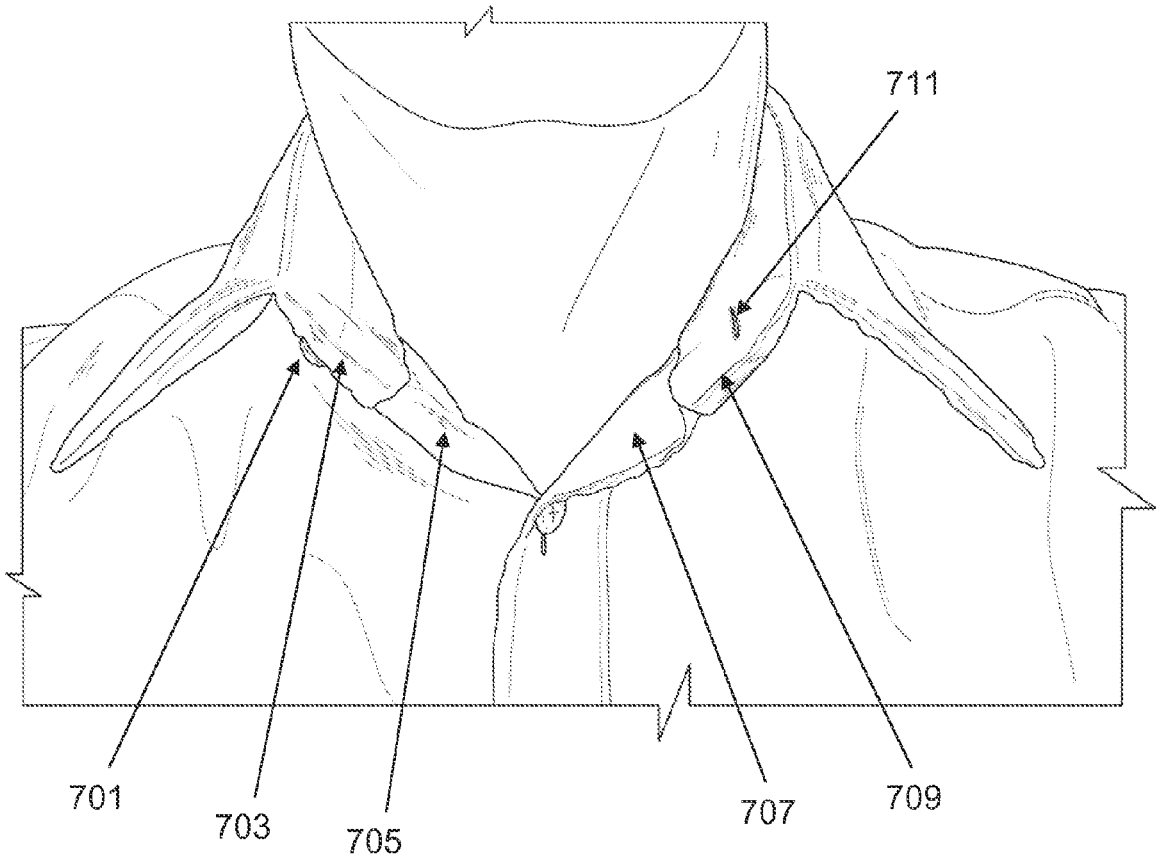
FIG. 7 shows a user-worn view of an attachable garment collar cover encapsulating a collar portion of a garment, in accordance with an embodiment of the invention.

FIG. 7 shows a user-worn view (700) of an attachable garment collar cover encapsulating a collar portion of a shirt, in accordance with an embodiment of the invention. In this embodiment of the invention, the attachable garment collar cover is shown with a first button hole edge (703), a second button hole edge (709), a first cover button hole fastened with a shirt collar button (701) of the shirt, and a second cover button hole (711), which overlaps an underlying shirt collar button hole. Furthermore, as shown in FIG. 7, a first side (705) of the shirt's collar and a second side (707) of the shirt's collar are inserted into a collar insert opening of the attachable garment collar cover, so that the attachable garment collar cover can encapsulate a substantial portion of the shirt's collar.

In one embodiment of the invention, the attachable garment collar cover may have an identical or similar color, styling, pattern, collar shape, collar sizing, and texture to the first side (705) and the second side (707) of the shirt's collar, so that undesirable visual or design contrasts between the attachable garment collar cover and both sides (705, 707) of the shirt's collar can be minimized. In another embodiment of the invention, the attachable garment collar cover may intentionally exhibit a unique, contrasting, and/or different color, styling, pattern, collar shape, collar sizing, and texture to at least one side of the shirt's collar, so that a unique fashion statement can be achieved when the attachable garment collar cover encapsulates the first side (705) and the second side (707) of the shirt's collar. Moreover, in another embodiment of the invention, the attachable garment collar cover may encapsulate a collar portion of another article of clothing, such as a dress, a coat, and a blouse, instead of the shirt as shown in FIG. 7.

Figure 8:
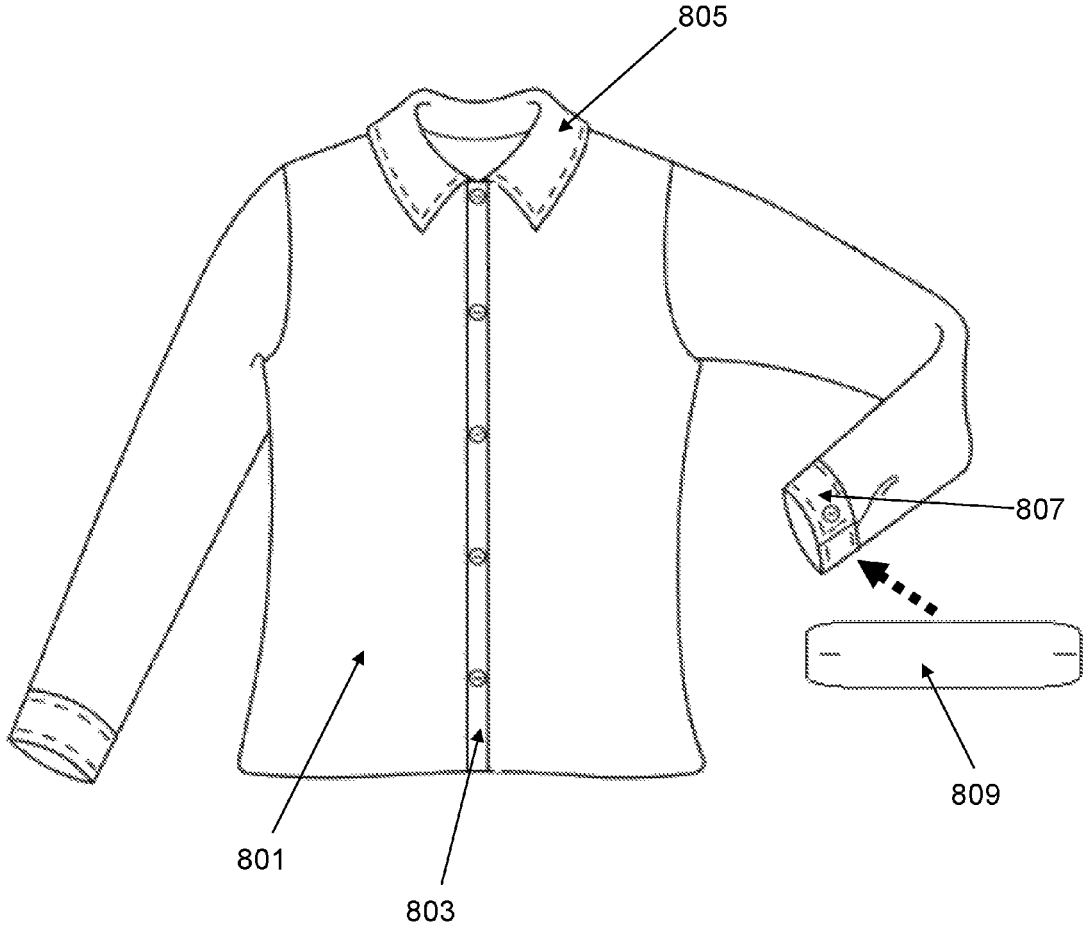
FIG. 8 shows a frontal perspective view of an attachable garment collar cover, an attachable shirt opening liner, and an attachable band cuff that are attached to a shirt, in accordance with an embodiment of the invention.

FIG. 8 shows a frontal perspective view (800) of an attachable garment collar cover (805), an attachable shirt opening liner (803), and an attachable band cuff (807, 809) that are fastened to a shirt (801), in accordance with an embodiment of the invention. In this embodiment of the invention, the attachable shirt opening liner (803) is a separate piece of clothing that can be removably attached to the shirt (801) and the attachable garment collar cover (805) for functional and/or aesthetic characteristics. For example, if the attachable garment collar cover (805) has a unique, contrasting, and/or different color, styling, pattern, collar shape, collar sizing, and texture to at least one side of the shirt's collar, a wearer may want to match the unique, contrasting, and/or different color, styling, pattern, collar shape, collar sizing, and texture of the attachable garment collar cover (805) with the similarly-colored, styled, patterned, and/or textured attachable shirt opening liner (803) in order to exhibit a coherent fashion statement.

Furthermore, the attachable shirt opening liner (803) may also protect an underlying center button area of the shirt (801) against staining and wear-and-tear near the underlying center button area. In addition, the attachable shirt opening liner (803) can also hide any existing stains and/or marks near the underlying center button area. As shown in FIG. 8, the attachable shirt opening liner (803) can be securely attached to the shirt (801) and the attachable garment collar cover (805) by placing each button of the shirt (801) into each corresponding button hole located on the attachable shirt opening liner (803). In another embodiment of the invention, clasps, zippers, clips, pins, and/or another attachment element may be utilized in combination with or instead of buttons and corresponding button holes.

Moreover, as also shown on FIG. 8, the attachable band cuff (809) can be securely fastened on a cuff area of the shirt (801) as an installed attachable band cuff (807), when the attachable band cuff (809) is wrapped around the cuff area of the shirt (801) and is fastened with a cuff button on the shirt (801). In another embodiment of the invention, zippers, clasps, clips, pins, and/or another attachment element may be utilized in combination with or instead of cuff buttons and corresponding button holes.

Furthermore, in another embodiment of the invention, instead of the shirt (801) as shown in FIG. 8, another article of clothing with a collar portion, such as a dress, a coat, or a blouse, may be used to fasten with the attachable garment collar cover (805) and/or the attachable band cuff (809).

Figure 9:
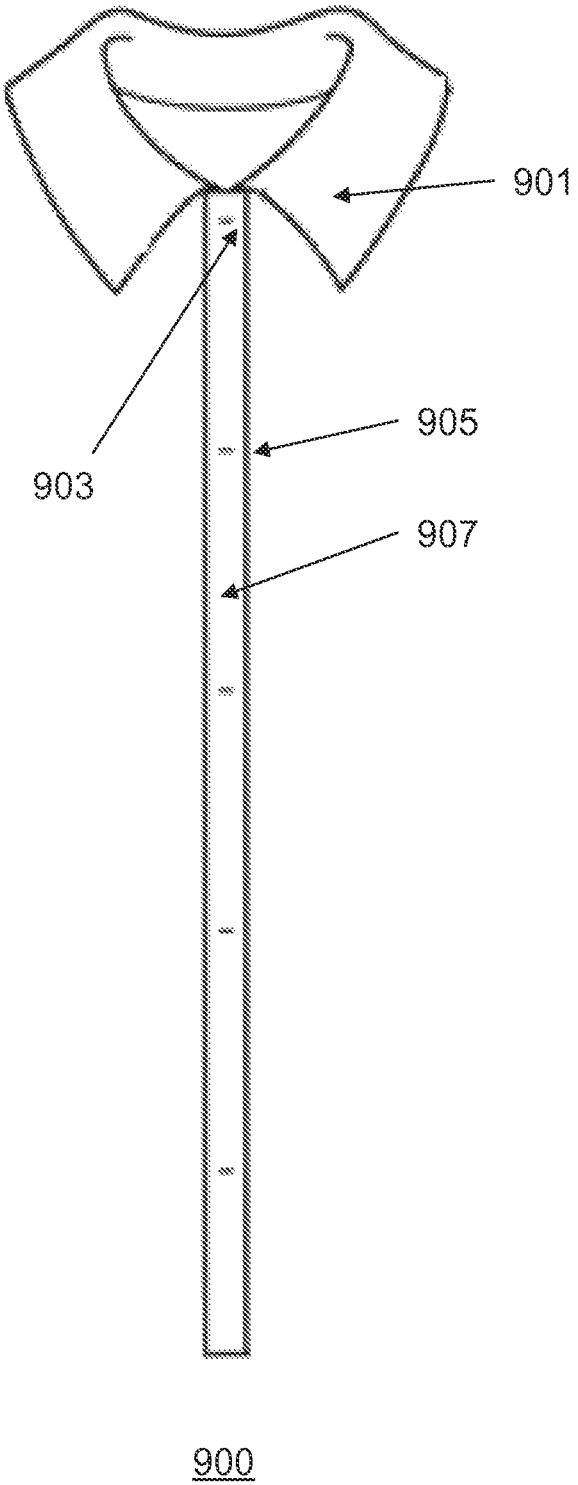
FIG. 9 shows a frontal view of an attachable garment collar cover with an attachable cloth opening liner, in accordance with an embodiment of the invention.

FIG. 9 shows a frontal view (900) of an attachable garment collar cover (901) with an attachable cloth opening liner (907), in accordance with an embodiment of the invention. In this embodiment of the invention, the attachable cloth opening liner (907) is a separate piece of clothing that can be removably attached to an article of clothing with a collar portion (e.g. a shirt, a dress, a coat, a blouse, and etc.) and the attachable garment collar cover (901) for functional and/or aesthetic characteristics. For example, if the attachable garment collar cover (901) has a unique, contrasting, and/or different color, styling, pattern, collar shape, collar sizing, and texture to the article of clothing with the collar portion, a wearer may want to match the unique, contrasting, and/or different color, styling, pattern, collar shape, collar sizing, and texture of the attachable garment collar cover (901) with the similarly-colored, styled, patterned, and/or textured attachable cloth opening liner (907) in order to exhibit a coherent fashion statement.

In the embodiment of the invention as shown in FIG. 9, a topmost attachable cloth opening liner button hole (903) can be fastened with a corresponding topmost button from a collar portion of an article of clothing. Preferably, the corresponding topmost button from the collar portion of the article of clothing is also capable of at least partially fastening the attachable garment collar cover (901). Furthermore, a second topmost attachable cloth opening liner button hole (905) can be fastened with a corresponding second topmost button from the article of clothing, as also illustrated in FIG. 8.

Moreover, in one embodiment of the invention, the attachable cloth opening liner (907) may also protect an underlying center button area of the article of clothing against staining and wear-and-tear near the underlying center button area. In addition, the attachable cloth opening liner (907) can also hide any existing stains and/or marks near the underlying center button area. The attachable clothing opening liner (907) can be made of single or multiple types of fabric. Preferably, the attachable cloth opening liner (907) can be securely attached to the article of clothing and the attachable garment collar cover (901) by placing each button of the article of clothing into each corresponding button hole located on the attachable cloth opening liner (907). Furthermore, in one embodiment of the invention, the attachable cloth opening liner (907) can sandwich a contacting portion of the attachable garment collar cover (901), which makes the attachable cloth opening liner (907) to encapsulate the underlying center button area of the article of clothing completely. In another embodiment of the invention, clasps, zippers, clips, pins, and/or another attachment element may be utilized in combination with or instead of buttons and corresponding button holes.

As shown and described above, various embodiments of the present invention disclose a novel attachable garment collar cover that provides significant advantages. For example, a novel attachable garment collar cover in accordance with an embodiment of the invention protects a garment's collar from stains and damages of daily wear and tear to extend the operating life of the garment. Furthermore, the novel attachable garment collar cover in accordance with an embodiment of the invention can provide an additional advantage of hiding existing damages to the garment's collar, which also extends the operating life of the garment.

In addition, the novel attachable garment collar cover in accordance with an embodiment of the invention can be conveniently detached from the garment for separate washing and cleaning, which in turn reduces the need for frequent washing of the garment. Moreover, the novel attachable garment collar cover in accordance with an embodiment of the invention also enables creating a different design, texture, pattern, styling, collar shape, collar sizing, and/or color profile from the garment, which in turn engenders a unique fashion statement in combination with the garment.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An attachable garment collar cover comprising:

a first collar cover blade made of a multilayer fabric;

a second collar cover blade made of the multilayer fabric;

a collar insert opening that extends to triangular edges of the first collar cover blade and the second collar cover blade, wherein the collar insert opening encapsulates a collar portion of an article of clothing, and wherein the triangular edges of the first collar cover blade and the second collar cover blade of the attachable garment collar cover encapsulate identically-shaped triangular edges of the collar portion of the article of clothing, when the collar portion is inserted into the collar insert opening;

a rear attachment element comprising at least one of an elastic, a zipper, a clasp, a clip, and a pin, wherein the rear attachment element is located on a rear portion of the attachable garment collar cover, and wherein the rear attachment element enables secure fastening of the collar portion of the article of clothing, when the collar portion is inserted into the collar insert opening;

a first cover button hole on the attachable garment collar cover that fastens with a topmost collar button among a regular vertical column of buttons that are not specially made for the attachable garment collar cover on the article of clothing, when the collar portion is inserted into the collar insert opening of the attachable garment cover;

a second cover button hole on the attachable garment collar cover that overlaps an underlying topmost button hole among a regular vertical column of button holes that are not specially made for the attachable garment collar cover on the article of clothing, wherein the second cover button hole is further configured to fasten with the topmost collar button, after the collar portion is inserted into the collar insert opening of the attachable garment cover; and a collar cover button on the attachable garment collar cover that fastens with the underlying topmost button hole among the regular vertical column of button holes that are not specially made for the attachable garment collar cover on the article of clothing, wherein the collar cover button is located on a same side as the second cover button hole on the attachable garment collar cover.

2. The attachable garment collar cover of claim 1, further comprising a first button hole edge underneath the first collar cover blade, wherein the first button hole edge contains the first cover button hole.

3. The attachable garment collar cover of claim 1, further comprising a second button hole edge underneath the second collar cover blade, wherein the second button hole edge contains the second cover button hole and a collar cover button.

4. The attachable garment collar cover of claim 1, further comprising an arched groove formed from curving the collar insert opening.

5. The attachable garment collar cover of claim 1, wherein the topmost collar button on the collar portion of the article of clothing also securely attaches an attachable cloth opening liner.

6. The attachable garment collar cover of claim 1, wherein the article of clothing securely attaches an attachable band cuff around a cuff portion of the article of clothing, and wherein the attachable band cuff has identical texture, pattern, styling, and color to the first collar cover blade and the second collar cover blade.

7. The attachable garment collar cover of claim 1, wherein the first collar cover blade and the second collar cover blade have identical texture, pattern, styling, and color to the article of clothing.

8. The attachable garment collar cover of claim 1, wherein the article of clothing is a shirt, a dress, a coat, or a blouse.

9. The attachable garment collar cover of claim 1, wherein the multilayer fabric is formed by stitching a multiple number of same, similar, or different fabric layers.

10. An attachable garment collar cover comprising:

a first collar cover blade made of a multilayer fabric;

a second collar cover blade made of the multilayer fabric;

a collar insert opening that extends to triangular edges of the first collar cover blade and the second collar cover blade, wherein the collar insert opening encapsulates a collar portion of an article of clothing, and wherein the triangular edges of the first collar cover blade and the second collar cover blade of the attachable garment collar cover encapsulate identically-shaped triangular edges of the collar portion of the article of clothing, when the collar portion is inserted into the collar insert opening;

a rear elastic located on a rear portion of the attachable garment collar cover, and wherein the rear elastic enables secure fastening of the collar portion of the article of clothing, when the collar portion is inserted into the collar insert opening;

a first cover button hole on the attachable garment collar cover that fastens with a topmost collar button among a regular vertical column of buttons that are not specially made for the attachable garment collar cover on the article of clothing, when the collar portion is inserted into the collar insert opening of the attachable garment cover;

a second cover button hole on the attachable garment collar cover that overlaps an underlying topmost button hole among a regular vertical column of button holes that are not specially made for the attachable garment collar cover on the article of clothing, wherein the second cover button hole is further configured to fasten with the topmost collar button, after the collar portion is inserted into the collar insert opening of the attachable garment cover; and a collar cover button on the attachable garment collar cover that fastens with the underlying topmost button hole among the regular vertical column of button holes that are not specially made for the attachable garment collar cover on the article of clothing, wherein the collar cover button is located on a same side as the second cover button hole on the attachable garment collar cover.

11. The attachable garment collar cover of claim 10, further comprising a first button hole edge underneath the first collar cover blade, wherein the first button hole edge contains the first cover button hole.

12. The attachable garment collar cover of claim 10, further comprising a second button hole edge underneath the second collar cover blade, wherein the second button hole edge contains the second cover button hole and a collar cover button.

13. The attachable garment collar cover of claim 10, further comprising an arched groove formed from curving the collar insert opening.

14. The attachable garment collar cover of claim 10, wherein the topmost collar button on the collar portion of the article of clothing also securely attaches an attachable cloth opening liner.

15. The attachable garment collar cover of claim 10, wherein the article of clothing securely attaches an attachable band cuff around a cuff portion of the article of clothing, and wherein the attachable band cuff has identical texture, pattern, styling, and color to the first collar cover blade and the second collar cover blade.

16. The attachable garment collar cover of claim 10, wherein the first collar cover blade and the second collar cover blade have identical texture, pattern, styling, and color to the article of clothing.

17. The attachable garment collar cover of claim 10, wherein the article of clothing is a shirt, a dress, a coat, or a blouse.

18. The attachable garment collar cover of claim 10, wherein the multilayer fabric is formed by stitching a multiple number of same, similar, or different fabric layers.

* * * * *